US008019241B2

(12) United States Patent
Hamaya

(10) Patent No.: US 8,019,241 B2
(45) Date of Patent: Sep. 13, 2011

(54) IMAGE FORMING APPARATUS

(75) Inventor: Masahito Hamaya, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 580 days.

(21) Appl. No.: 12/199,566

(22) Filed: Aug. 27, 2008

(65) Prior Publication Data

US 2009/0060535 A1 Mar. 5, 2009

(30) Foreign Application Priority Data

Aug. 27, 2007 (JP) ..... 2007-219822

(51) Int. Cl.
*G03G 15/02* (2006.01)
*G03G 21/00* (2006.01)

(52) U.S. Cl. ..... 399/31; 399/34

(58) Field of Classification Search ..... 399/31, 399/34, 37, 50, 98–100
See application file for complete search history.

(56) References Cited

U.S. PATENT DOCUMENTS

2007/0147858 A1 6/2007 Inukai

FOREIGN PATENT DOCUMENTS

| | | |
|---|---|---|
| JP | 6-130788 | 5/1994 |
| JP | 9-297456 | 11/1997 |
| JP | 2006-184826 | 7/2006 |
| JP | 2007-178595 | 7/2007 |

OTHER PUBLICATIONS

Japanese Official Action dated Sep. 1, 2009 together with English translation.

*Primary Examiner* — David M Gray
*Assistant Examiner* — Gregory H Curran
(74) *Attorney, Agent, or Firm* — Scully, Scott, Murphy & Presser, PC

(57) ABSTRACT

An image forming apparatus is provided. The image forming apparatus includes: a photosensitive member; a discharging unit arranged to face the photosensitive member; a high-voltage power supply unit which supplies power to the discharging unit; a discharge detection unit which detects abnormal discharge in the discharging unit; an output controller which controls an output of the high-voltage power supply unit according to control information; and a cleaning detection unit which compares current control information for the high-voltage power supply unit supplying power to the discharging unit in which abnormal discharge is detected with previous control information for the high-voltage power supply unit when previous abnormal discharge is detected in the discharging unit, and which detects whether the discharging unit has been cleaned based on the comparison result.

18 Claims, 10 Drawing Sheets

IMAGE FORMING APPARATUS

CROSS-REFERENCE TO RELATED APPLICATION

This application claims priority from Japanese Patent Application No. 2007-219822, filed on Aug. 27, 2007, the entire subject matter of which is incorporated herein by reference.

TECHNICAL FIELD

Aspects of the present invention relate to an image forming apparatus, such as a printer, a multi function device, a copy machine, or a facsimile machine.

BACKGROUND

An image forming apparatus, such as a printer, a multi function device, a copy machine, or a facsimile machine, performs printing on a recording sheet by an electrophotographic process. In the electrophotographic process, a charger generates corona discharge to form a surface potential on a photosensitive member, and an electrostatic latent image is formed on the surface of the photosensitive member by an exposure device. Thereafter, toner is attached to the photosensitive member to visualize the electrostatic latent image, and toner on the photosensitive member is transferred and fixed to the recording sheet. After toner is transferred to the recording sheet, non-transferred toner remaining on the photosensitive member is cleaned, and the residual surface potential is eliminated by a static eliminator.

While the image forming apparatus repeats printing, toner or sheet dust is stuck to a wire of the charger or the static eliminator, and the wire is thickened. The thickened wire becomes closer to the photosensitive member. This thickened wire or a crack occurs in the distribution of a toner attached to the photosensitive member might causes arc discharge. In the image forming apparatus, if arc discharge is generated, corona discharge which is normal discharge is obstructed. For this reason, black lines and streaks appear, and accordingly printing performance is seriously deteriorated. In addition, the recording sheet or toner is wasted.

Accordingly, there has been suggested a technique to detects abnormality in the charger or the static eliminator. For example, JP-A-2007-178595 describes an image forming apparatus including: four photosensitive members to which toner of yellow, magenta, cyan and black are supplied, respectively; chargers and static eliminators which are opposed to the four photosensitive members, respectively and to which power is supplied from a high-voltage power supply unit; and a discharge detection circuit which is connected to each charger or each static eliminator and detects abnormal discharge of the charger or the static eliminator. According to the image forming apparatus described in JP-A-2007-178595, a user can be asked to clean the charger or the static eliminator in which abnormal discharge is detected. As a result, deterioration in printing performance and wasteful recording sheet or toner can be suppressed.

However, related-art image forming apparatuses can detect abnormal discharge of the charger or the static eliminator but do not confirm whether the user actually cleans the charger or the static eliminator. Therefore, if the user executes re-printing before the charger or the static eliminator is cleaned, abnormal discharge is generated again in the image forming apparatus. In the image forming apparatus, the charger or the static eliminator may be broken down if such abnormal discharge occurs repeatedly.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus which can confirm whether a charger or a static eliminator is cleaned after abnormal discharge is generated.

According to an exemplary embodiment of the present invention, there is provided an image forming apparatus including: a photosensitive member; a discharging unit arranged to face the photosensitive member; a high-voltage power supply unit which supplies power to the discharging unit; a discharge detection unit which detects abnormal discharge in the discharging unit; an output controller which controls an output of the high-voltage power supply unit according to control information; and a cleaning detection unit which compares current control information for the high-voltage power supply unit supplying power to the discharging unit in which abnormal discharge is detected with previous control information for the high-voltage power supply unit when previous abnormal discharge is detected in the discharging unit, and which detects whether the discharging unit has been cleaned based on the comparison result.

According to another exemplary embodiment of the present invention, there is provided an image forming unit including: a plurality of photosensitive members; a plurality of discharging units arranged to face the plurality of photosensitive members, respectively; a plurality of high-voltage power supply units which are provided for the plurality of discharging units and supply power to the plurality of discharging units, respectively; a discharge detection unit which detects abnormal discharge in the plurality of discharging units; an output controller which controls outputs of the high-voltage power supply units according to control information, respectively; a cleaning detection unit which compares current control information for one of the high-voltage supply units corresponding to one of the discharging unit in which abnormal discharge is detected with previous control information for the one of the high-voltage supply units when previous abnormal discharge is detected in the one of the discharging units, and which detects whether the one of the discharging units has been cleaned based on the comparison result.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

An image forming apparatus according to exemplary embodiments of the present invention will now be described with reference to the drawings.

First Exemplary Embodiment

Figure 1:
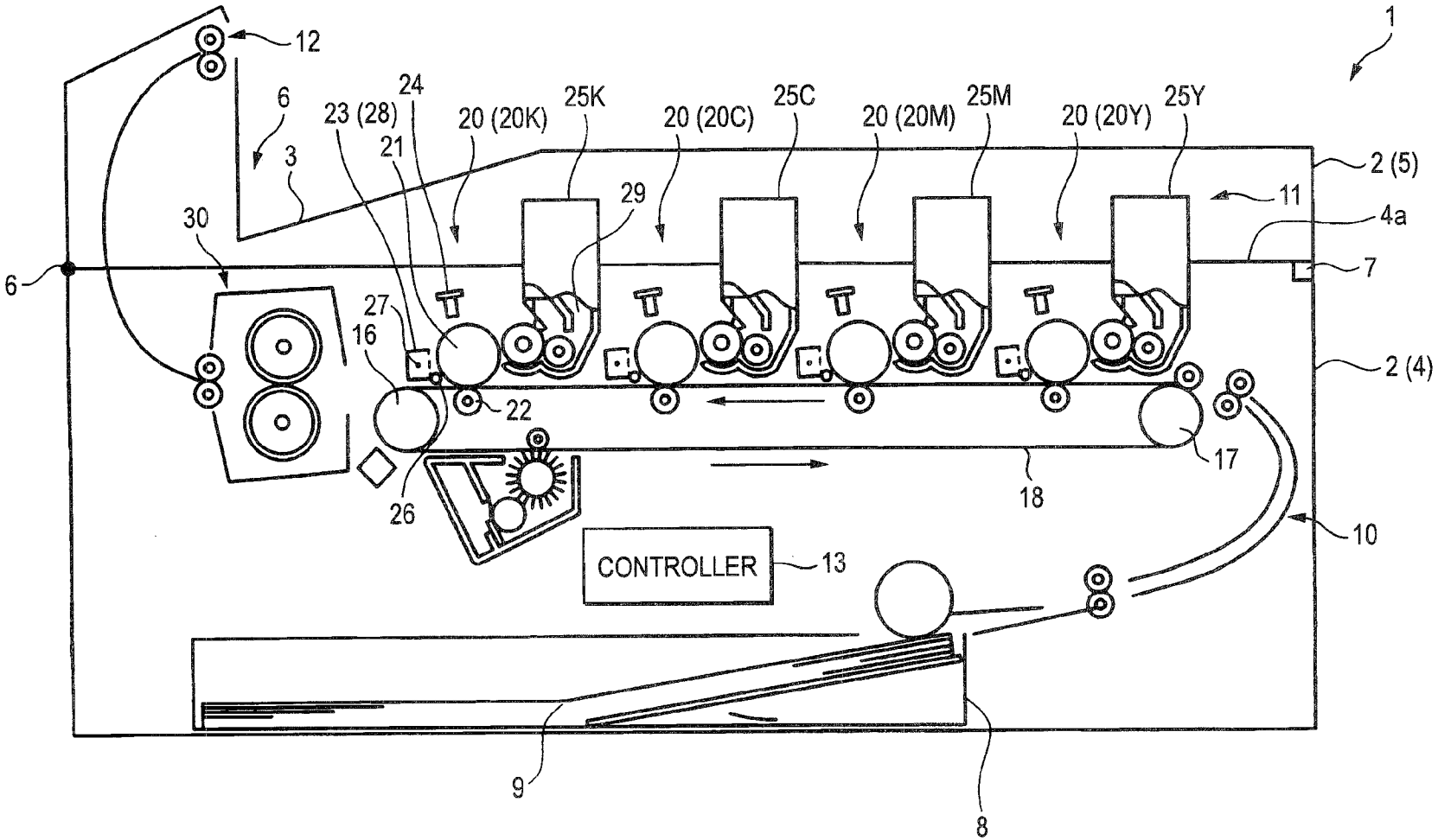
FIG. 1 is a sectional view of an image forming apparatus according to a first exemplary embodiment of the invention.

FIG. 1 is a sectional view of a printer 1 according to a first exemplary embodiment of the invention.

When a discharge detection circuit 40 detects abnormal discharge of a charger 23 or a static eliminator 26, the printer 1 compares current control information for controlling output of the high-voltage power supply unit 41 to the charger 23 or the static eliminator 26 having detected abnormal discharge with previous control information for controlling output of the high-voltage power supply unit 41 to the charger 23 or the static eliminator 26 having detected abnormal discharge when previous abnormal discharge is detected in the charger 23 or the static eliminator 26 having detected abnormal discharge. Then, it is determined whether the charger 23 or the static eliminator 26 having detected abnormal discharge has been cleaned.

Herein, the term "output" is a concept including power (for example, supply current or output voltage) which is supplied from the high-voltage power supply unit 41 to the charger 23, and control information (PWM control signal) for control of output power of the high-voltage power supply unit 41. The output of the high-voltage power supply unit 41 has the same voltage value but different absolute signs in a plus power source and a minus power source. Accordingly, if the "output voltage" is taken as "output", the absolute value of the output voltage is assumed to be the "output". In this exemplary embodiment, it is assumed that the output of the high-voltage power supply unit 41 is a plus power source.

<Configuration of Printer>

In FIG. 1, the printer I is a so-called tandem-type color electrophotographic printer in which four image forming units 20 are arranged in a horizontal direction. The printer 1 is provided with a sheet discharging tray 3 on an upper surface of a body casing 2.

The body casing 2 has a body portion 4 having an opening at an upper surface thereof and a cover 5 that is rotatably connected to the body portion 4 through a hinge 6 to cover the opening 4*a* of the body portion 4. To the inner wall of the body portion 4, an open/close detection sensor 7 is attached which detects an open/close state of the cover 5.

The printer 1 picks up a recording sheet 9 stacked in a sheet feeding cassette 8 by a feeder unit 10 and conveys the recording sheet 9 to an image forming part 11. The image forming part 11 forms an image on the recording sheet 9. Then, the recording sheet 9 is discharged from a sheet discharge part 12 to the sheet discharging tray 3. The printer 1 controls a printing operation by a controller 13.

In the cover 5 of the printer 1, as described below, an operation unit 14 for inputting an operation instruction and a display unit 15 for displaying data are provided.

<Configuration of Image Forming Unit>

The image forming part 11 includes image forming units 20Y, 20M, 20C, and 20K, transfer rollers 22, and a fixing part 28.

The image forming units 20Y, 20M, 20C, and 20K supply yellow (Y) toner, magenta (M) toner, cyan (C) toner, and black (K) toner to photosensitive members 21, respectively. The image forming units 20Y, 20M, 20C, and 20K are arranged in a horizontal direction along a convey belt 18 wound around a driving roller 16 and a driven roller 17. The image forming units 20Y, 20M, 20C, and 20K have the same structure. The appended characters Y, M, C, and K are used to distinguish the image forming units 20 for toner of the respective colors. In the following description, in case that it is not necessary to particularly distinguish the image forming units 20Y, 20M, 20C, and 20K, the appended characters Y, M, C, and K will be omitted. For the purpose of making the drawing more understandable, in FIG. 1, only the constituent elements of the image forming unit 20K are referenced by reference numerals.

The image forming unit 20 is rotatably held in the body portion 4 while the photosensitive member 21 comes into contact with the surface of the convey belt 18. The photosensitive member 21 is opposed to the transfer roller 22 for applying a transfer bias with the convey belt 18 interposed therebetween. Around the photosensitive member 21, a charger 23, an exposure unit 24, a developing unit 25, and a static eliminator 26 are arranged.

The charger 23 includes a charging wire 27 and a GRID portion 28 arranged around the charging wire 27. The charger 23 generates corona discharge on the surface of the photosensitive member 21 by the charging wire 27 to form a surface potential on the photosensitive member 21. The exposure unit 24 irradiates laser light onto the surface of the photosensitive member 21, which is positively charged by the charger 23, to thereby form an electrostatic latent image. The developing unit 25 supplies toner 29 to the surface of the photosensitive member 21, on which the electrostatic latent image is formed, to thereby visualize the electrostatic latent image. For the purpose of facilitating replacement of toner 29, the developing unit 25 is removably attached to the body portion 4 through the opening 4*a*. The photosensitive member 21 transfers a toner image to the recording sheet 9 which is conveyed between the photosensitive member 21 and the transfer roller 22 by the convey belt 18. The static eliminator 26 generates corona discharge on the surface of the photosensitive member 21 to eliminate the residual surface potential on the photosensitive member 21.

The image forming part 11 thermally fixes the toner image, which is transferred to the recording sheet 9 by the image forming unit 20, to the recording sheet 9 by a fixing part 30, and sends the recording sheet 9, on which an image is formed, to the sheet discharge part 12.

<Electrical Configuration of Color Electrophotographic Printer>

Figure 2:
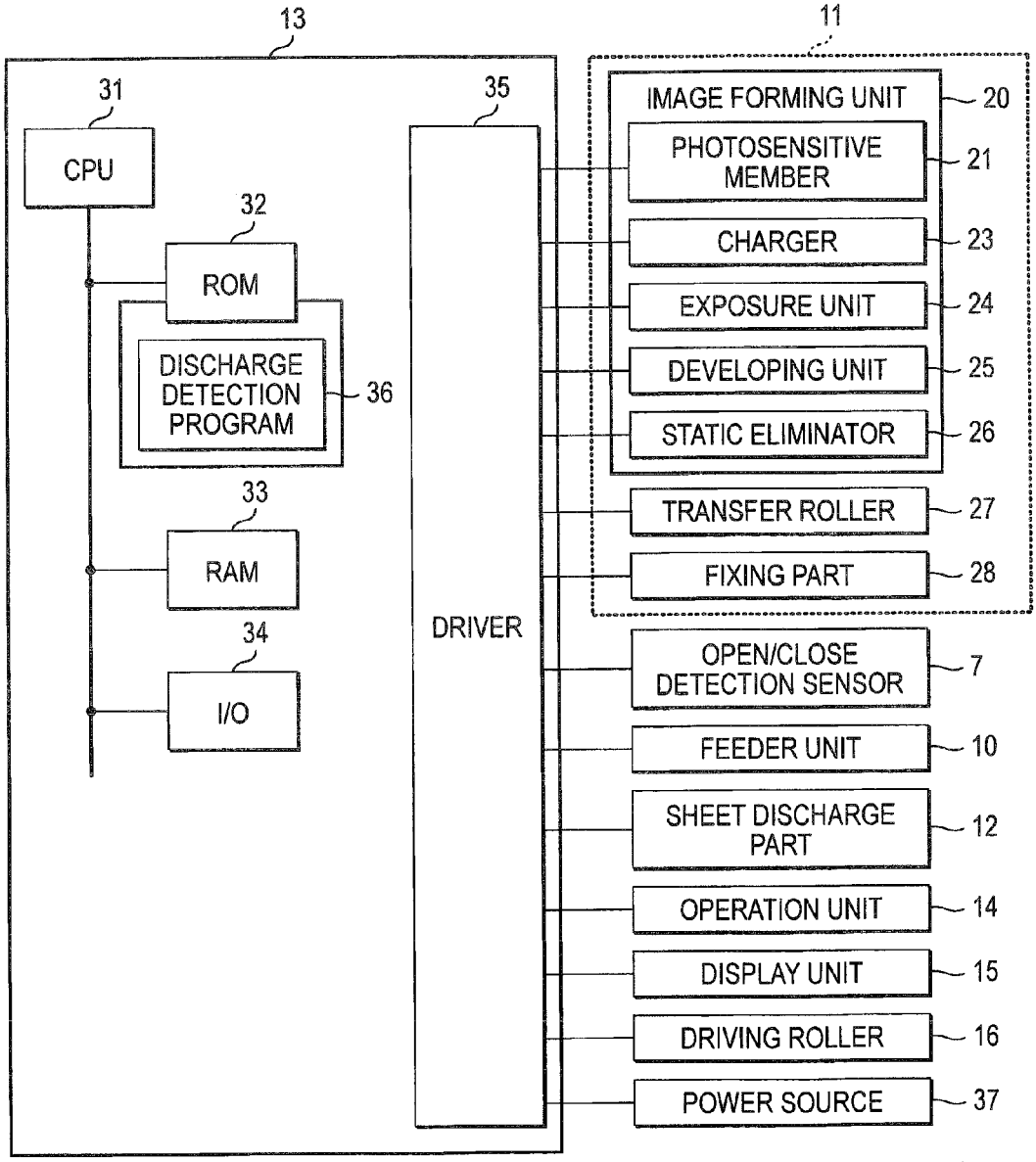
FIG. 2 is a block diagram schematically showing the electrical configuration of the image forming apparatus shown in FIG. 1.

Next, together with the electrical configuration of the printer 1, a process until the printer 1 forms a color image on the recording sheet 9 through cooperative operations of the above-described units provided in the apparatus will be described with reference to FIG. 2. FIG. 2 is a block diagram schematically showing the electrical configuration of the printer 1.

As shown in FIG. 2, the printer 1 includes a controller 13 incorporating a CPU 31, a ROM 32, a RAM 33, an input/output interface (hereinafter, referred to as "I/O") 34, a driver 35. The controller 13 performs general control of the units in the apparatus. The ROM 32 stores a discharge detection program 36 described below.

The controller 13 is connected to the open/close detection sensor 7 to monitor an open/close state of the cover 5. The controller 13 is also connected to the operation unit 14 and the display unit 15 to receive an instruction from the operation unit 14 or to cause the display unit 15 to display data.

The controller 13 is connected to the feeder unit 10, the image forming part 11, the sheet discharge part 12, the driving roller 16, and a power source 27, and controls a printing operation. The image forming part 11 includes the image forming unit 20, the transfer rollers 22, and the fixing part 28. The image forming unit 20 includes the photosensitive member 21, the charger 23, the exposure unit 24, the developing unit 25 and the static eliminator 26.

<Discharge Detection Circuit>

Figure 3:
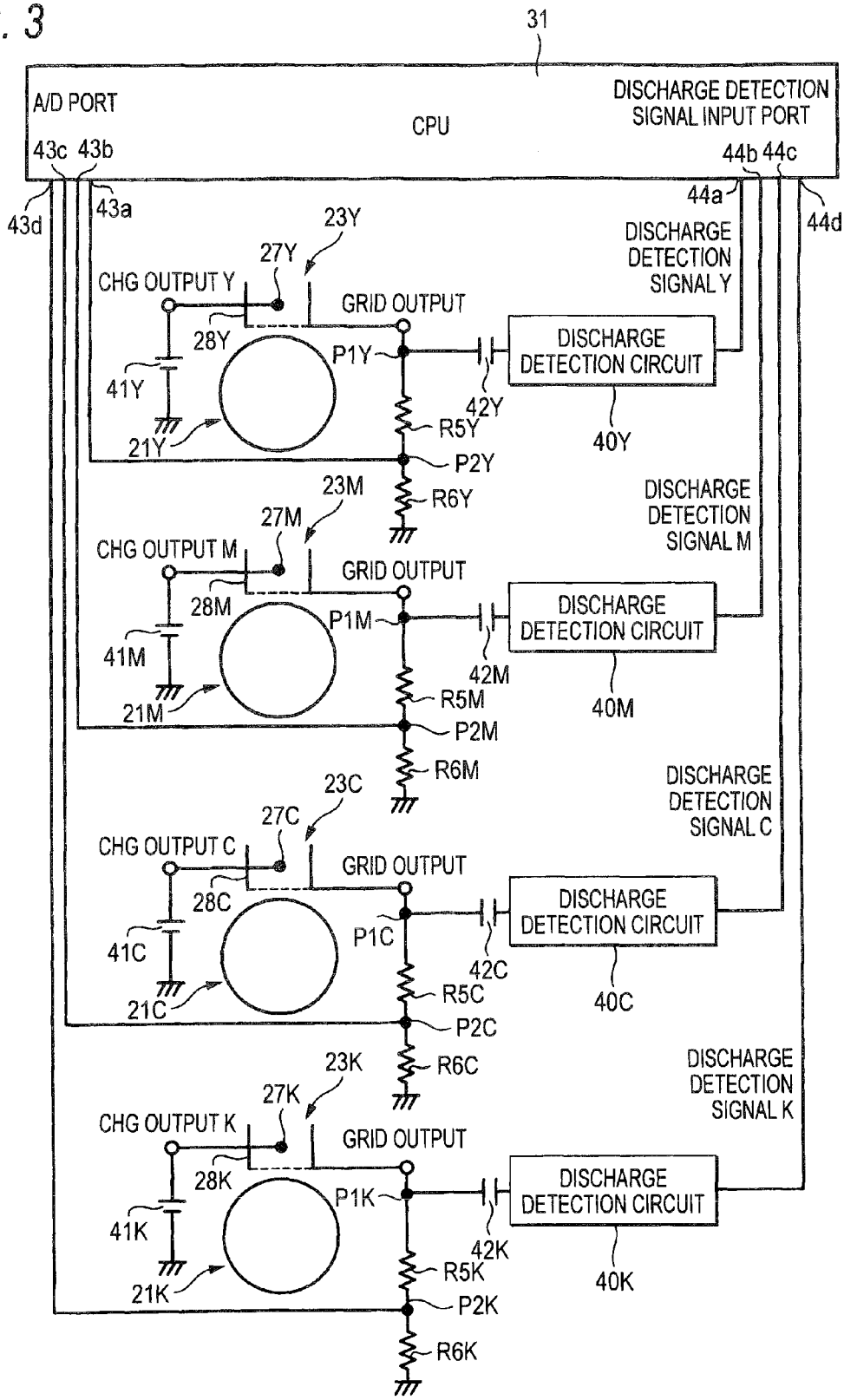
FIG. 3 is a diagram showing a discharge detection circuit which is used in the image forming apparatus shown in FIG. 1.

FIG. 3 is a diagram showing discharge detection circuits 40Y, 40M, 40C, and 40K which are used in the printer 1 shown in FIG. 1.

The discharge detection circuits 40Y, 40M, 40C, and 40K are provided correspondingly to chargers 23Y, 23M, 23C, and 23K.

The charger 23 is opposed to the photosensitive member 21 one-to-one. The charger 23 is applied with a high charge voltage generated by the high-voltage power supply unit 41, to thereby charge the photosensitive member 21. The configuration of the high-voltage power supply unit 41 will be described below. The voltage applied to the charger 23 generates corona discharge between the charging wire 27, the GRID portion 28, and the photosensitive member 21, to thereby charge the photosensitive member 21. For this reason, the potential of the photosensitive member 21 is determined depending on the potential of the GRID portion 28.

The GRID portion 28 outputs a current toward a connection point P1 by a voltage generated during discharge. To the connection point P1, a resistor R5 and a capacitor 42 are connected in parallel. In this exemplary embodiment, the capacitor 42 cuts off a direct current (DC) component in the voltage at the connection point P1 and outputs only an alternating current (AC) component toward the discharge detection circuit 40. To the resistor R5, a resistor R6 is connected in series through a connection point P2.

The CPU 31 includes a first A/D port 43*a*, a second A/D port 43*b*, a third A/D port 43*c*, and a fourth A/D port 43*d*. The first to fourth A/D ports 43*a*, 43*b*, 43*c*, and 43*d* are connected to connection points P2Y, P2M, P2C, and P2K of the first to fourth chargers 23Y, 23M, 23C, and 23K, respectively, and monitor the voltage value (current value) in the GRID portion 28. If the first to fourth A/D ports 43*a*, 43*b*, 43*c*, and 43*d* do not need to he distinguished from each other, they are simply referred to as an "A/D port 43" in the description and the drawings.

The CPU 31 also includes a first discharge detection signal input port 44*a*, a second discharge detection signal input port 44*b*, a third discharge detection signal input port 44*c*, and a fourth discharge detection signal input port 44*d*. The first to fourth discharge detection signal input ports 44*a*, 44*b*, 44*c*, and 44*d* are connected to the discharge detection circuits 40Y, 40M, 40C, and 40K, respectively, and monitor discharge detections signals Y, M, C, and K output from the discharge detection circuits 40Y, 40M, 40C, and 40K.

<Specific Configuration of Discharge Detection Circuit>

Figure 4:
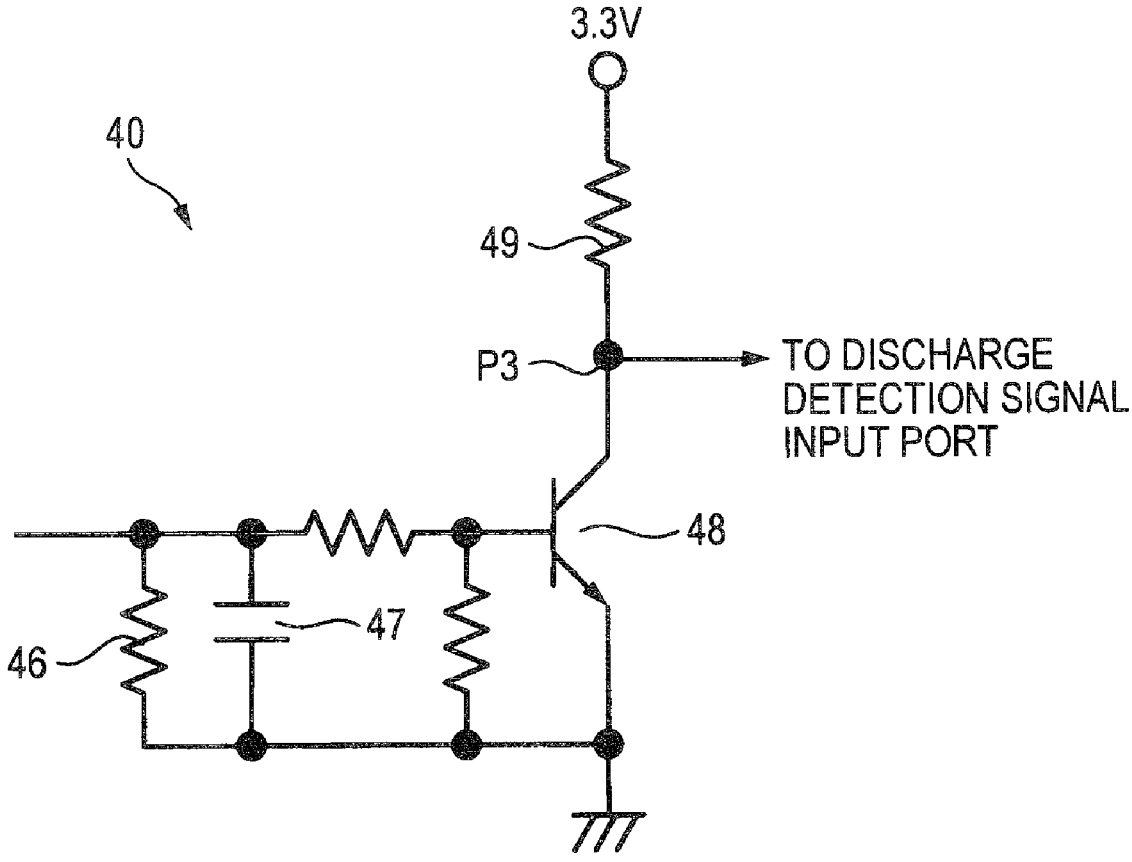
FIG. 4 is a diagram showing the configuration of the discharge detection circuit shown in FIG. 3.

FIG. 4 is a diagram showing the configuration of the discharge detection circuit 40 shown in FIG. 3. The discharge detection circuits 40Y, 40M, 40C, and 40K have the same configuration, and thus FIG. 4 shows only one discharge detection circuit 40.

The discharge detection circuit 40 includes a resistor 46, a capacitor 47, a transistor 48, and a resistor 49. The resistor 46 and the capacitor 47 are provided in order to adjust the voltage from the capacitor 42 (see FIG. 3). That is, the resistor 46 adjusts the voltage supplied from the capacitor 42, and the capacitor 47 decreases a peak value of the voltage supplied from the capacitor 42 (see FIG. 3), such that an output signal to be output to the transistor 48 is taken out. Therefore, even if the voltage supplied from the capacitor 42 includes noise, since the transistor 48 reacts with only the output signal which applies a large voltage, which is a predetermined voltage or higher, to the connection point P1, the discharge detection circuit 40 can eliminate the influence of noise on discharge detection.

In the transistor 48, an emitter is connected to the ground, a collector is connected to the power source through a resistor 49, and a base is connected to the capacitor 42. The connection point P3 is provided between the transistor 48 and the resistor 49, and connected to the discharge detection signal input port 44 provided in the CPU 31. The resistor 49 is provided in order to pull up the voltage of the connection point P3.

The discharge detection circuit 40 of the CPU 31 shown in FIG. 3 detects presence/absence of abnormal discharge on the basis of the voltage (discharge detection signal) applied to the discharge detection signal input port 44. If no current flows between the collector and the emitter of the transistor 48, and the voltage of the connection point P3 is substantially at 3.3 V, the CPU 31 determines that the discharge detection signal input port 44 is put in a high state (hereinafter, also referred to as "H") and the charger 23 performs normal discharge, that is, corona discharge. Meanwhile, if a current flows between the collector and the emitter of the transistor 48, and the voltage of the connection point P3 decreases and becomes 0 V or enters in a state close to 0 V, CPU 31 determines that the discharge detection signal input port 44 is put in a low state (hereinafter, also referred to as "L") and abnormal discharge, that is, arc discharge is partially generated in the charging wire 27 constituting the charger 23.

<High-Voltage Power Supply Unit>

Figure 5:
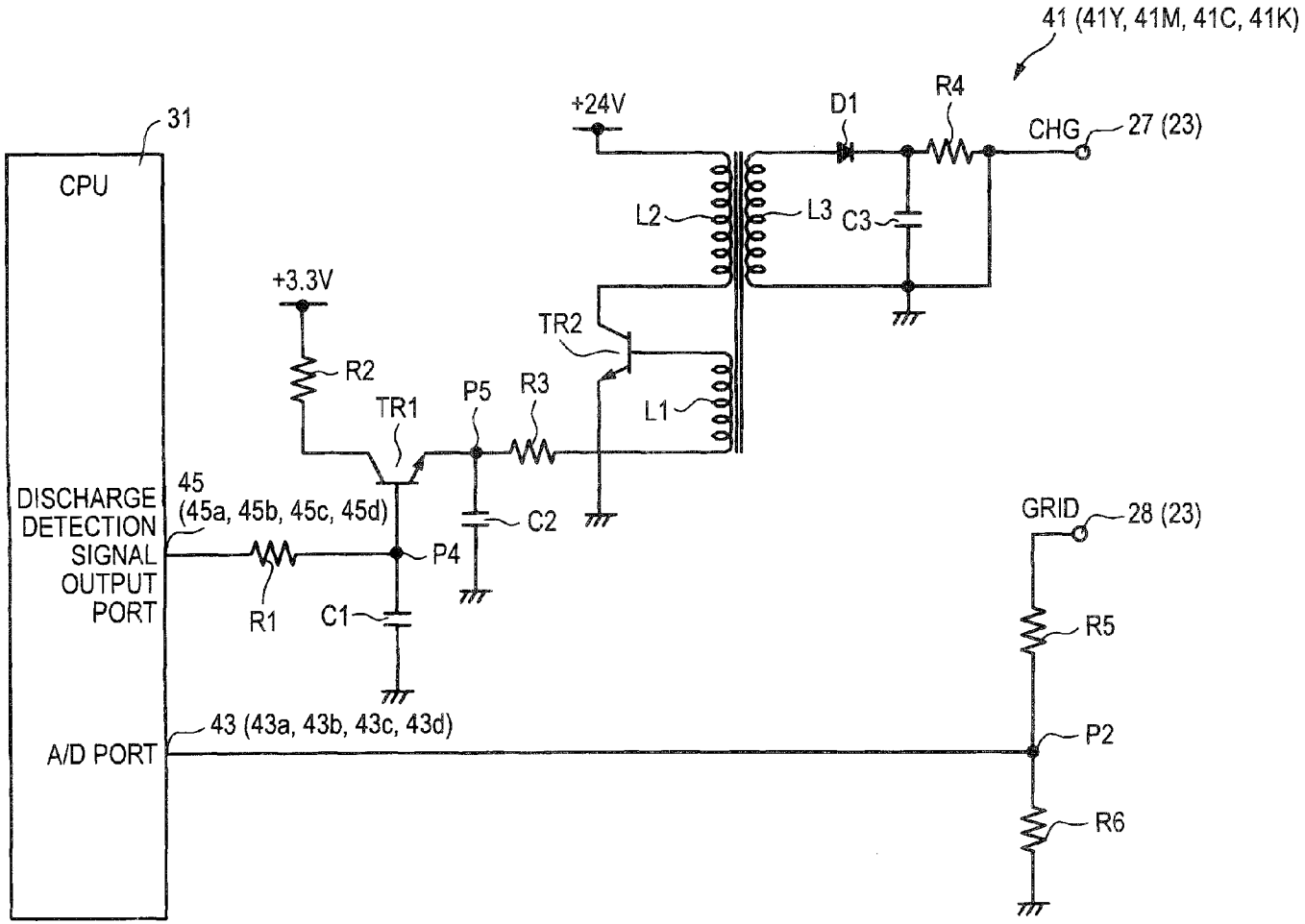
FIG. 5 is a circuit diagram of a high-voltage power supply unit shown in FIG. 3.

FIG. 5 is a block diagram of the high-voltage power supply unit 41 shown in FIG. 3. The high-voltage power supply units 41Y, 41M, 41C, and 41K are provided correspondingly to the chargers 23Y, 23M, 23C, and 23K, but since they have the same configuration, FIG. 5 shows only one high-voltage power supply unit 41.

The high-voltage power supply unit 41 applies the high voltage to the corresponding charger 23. The CPU 31 includes control information output ports 45 (45*a*, 45*b*, 45*c*, and 45*d*), from which PWM control signals as an example of control information, according to the number of chargers 23. The high-voltage power supply unit 41 controls a voltage to be applied to the charger 23 according to the PWM control signal output from the control information output port 45.

The control information output port 45 of the CPU 31 is connected to a base of a transistor TR1 through a resistor R1 the high-voltage power supply unit 41. A connection point P4 between the resistor R1 and the transistor TR1 is connected to the ground through a capacitor C1. The resistor R1 is provided in order to adjust a voltage to be applied from the control information output port 45 to the connection point P4, and the capacitor C1 is provided in order to smooth a voltage to be applied to the base of the transistor TR1.

In the transistor TR1, a collector is connected to the power source through a resistor R2, an emitter is connected to a resistor R3, and a base is connected to the control information output port 45 of the CPU 31 through the connection point P4, as described above. A connection point P5 provided between the transistor TR1 and the resistor R3 is connected to the ground through a capacitor C2. The resistor R3 is connected to a base of a transistor TR2 through a coil L1.

If no voltage is applied from the CPU 31 to the base of the transistor TR1, no current flows between the collector and the emitter of the transistor TR1. In this case, no voltage is applied to the base of the transistor TR2 and no current flows between the collector and the emitter of the transistor TR2. Meanwhile, if a voltage is applied from the CPU 31 to the base of the transistor TR1, a current flows between the collector and the emitter of the transistor TR1. Therefore, a voltage is applied to the base of the transistor TR2 and a current flows between the collector and the emitter of the transistor TR2.

Therefore, the transistor TR1 is switched between a conductive state and a non-conductive state in synchronization with the transistor TR1. The collector of the transistor TR2 is connected to a primary coil L2 of a transformer. When a current flows between the collector and the emitter of the transistor TR2, the transformer boosts a voltage (for example, 24 V) applied from the power source to the primary coil L2 to, for example, 6000 to 8000 V according to a winding ratio of the primary coil L2 and a secondary coil L3. As a result, the transformer outputs a high voltage according to the switching operation of the transistor TR2 between the conductive state and the non-conductive state.

The secondary coil L3 of the transformer is connected to the charger 23 through a diode D1 and a resistor R4. The output from the secondary coil L3 is commutated in the diode D1, then converted into a smooth DC current in a capacitor C3, and subsequently supplied to the charger 23. The resistor R4 is a resistor for short-circuit protection. As a result, a constant current is supplied to the charger 23. In this exemplary embodiment, a current of 300 μA is supplied to the charger 23.

If a high voltage (for example, 6000 to 8000 V) is applied to the scorotron-type charger 23, corona discharge is generated in the charging wire 27. Multiple ions are generated around the charging wire 27, and then discharged to the photosensitive member 21 (see FIG. 3) and the GRID portion 28. Thus, a current flows in the GRID portion 28. For example, when the charger 23 performs normal discharge, a current of 275 μA flows in the GRID portion 28. Resistors R5 and R6 are connected to the GRID portion 28, and a voltage is generated at a connection point P2 provided between the resistors R5 and R6. The connection point P2 is connected to the A/D port 43 (43*a*, 43*b*, 43*c*, and 43*d*) of the CPU 31.

The CPU 31 outputs the PWM control signal through the control information output port 45 (45*a*, 45*b*, 45*c*, and 45*d*) such that the voltage supplied to the AID port 43 (43*a*, 43*b*, 43*c*, and 43*d*) is controlled to be constant, that is, the current value from the GRID portion 28 is controlled to be constant. In other words, the voltage of the GRID portion 28 becomes constant. Thus, a charge voltage to be applied to the charger 23 is stabilized.

For example, when the current value from the GRID portion 28 is small, that is, when the voltage of the GRID portion 28 is low, the CPU 31 determines that the charge voltage is low, and increase the duty value of the PWM control signal, to thereby increase the voltage to be applied from the high-voltage power supply unit 41. Meanwhile, when the current value from the GRID portion 28 is large, that is, when the voltage of the GRID portion 28 is high, the CPU 31 determines that the charge voltage is high, and decreases the duty value of the PWM control signal, to thereby decrease the voltage to be applied from the high-voltage power supply unit 41. Therefore, the voltage applied from the high-voltage power supply unit 41 to the charger 23 is ideally proportional to the duty value of the PWM control signal output from the control information output port 45 (45*a*, 45*b*, 45*c*, and 45*d*).

<Operation>

Subsequently, the operation of the printer 1 will be described.

Figure 6:
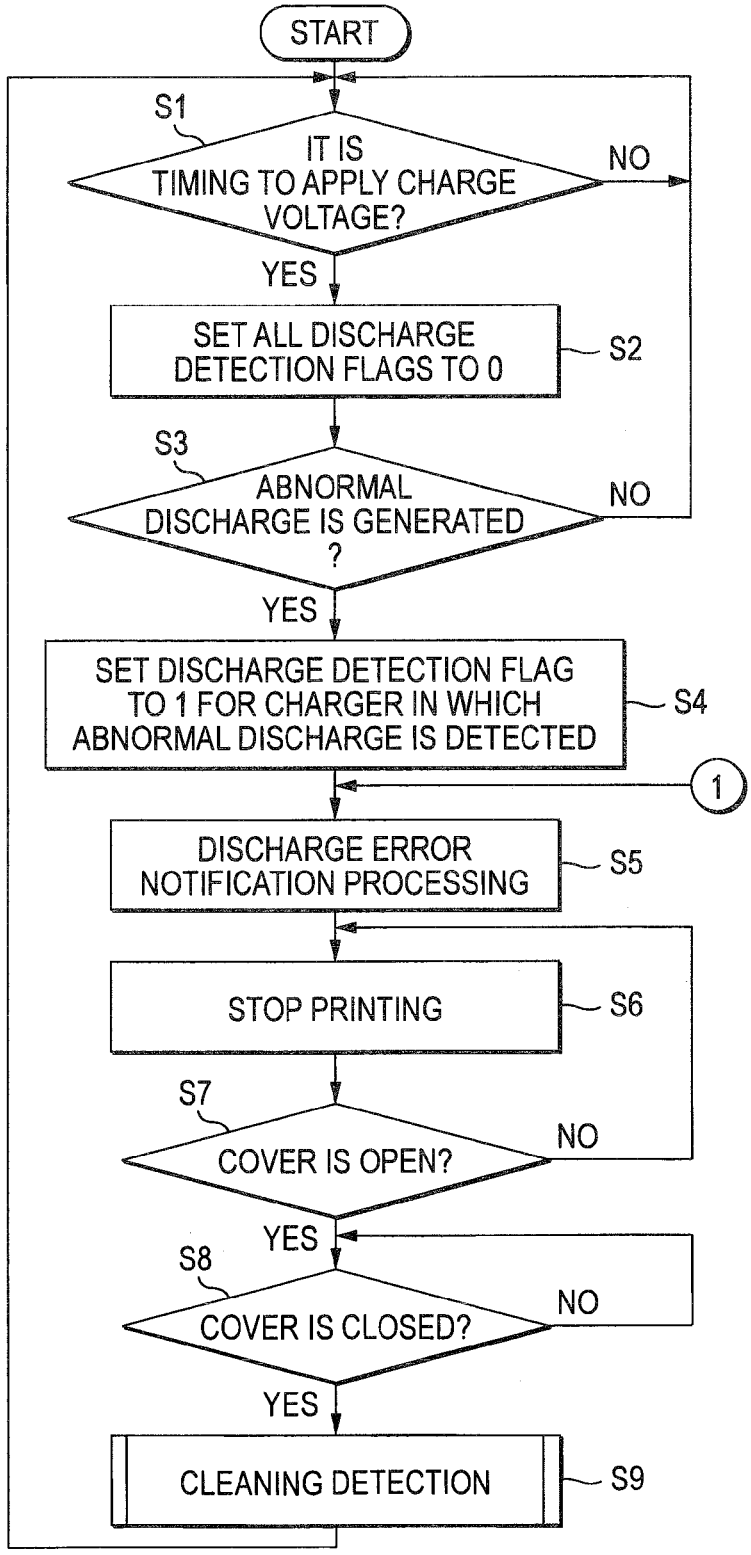
FIG. 6 is a flowchart of a discharge detection program shown in FIG. 2.

If the printer 1 is supplied with power from a power source 37, the CPU 31 copies a discharge detection program 36 from the ROM 32 to the RAM 33, and executes the discharge detection program 36 at a predetermined time interval. FIG. 6 shows a flowchart of the discharge detection program 36.

The CPU 31 of the printer 1, in Step 1 (hereinafter, referred to as "S1") of FIG. 6, determines whether it is an application timing to apply the charge voltage to the first to fourth chargers 23Y, 23M, 23C, and 23K. In this exemplary embodiment, a timing when power is supplied from the power source 37 and a warming-up operation is performed, or a timing when print data is input and printing is performed is determined as the application timing.

If it is determined that it is not the application timing (S1: NO), the first to fourth chargers 23Y, 23M, 23C, 23K do not generate discharge, and the photosensitive members 21Y, 21M, 21C, and 21K are not charged. Then, the operation returns to S1. If it is determined that it is the application timing (S1: YES), in S2, discharge detection flags provided in the RAM 33 to correspond to the chargers 23Y, 23M, 23C, and 23K are all set to zero, and an initial operation is performed. Next, in S3, it is determined whether abnormal discharge is generated in the chargers 23Y, 23M, 23C, and 23K.

When the first to fourth discharge detection signal input ports 44*a*, 44*b*, 44*c*, and 44*d* are put in the "H" according to the discharge detection signals Y, M, C, and K from the discharge detection circuits 40Y, 40M, 40C, and 40K, respectively, the CPU 31 determines that the first to fourth chargers 23Y, 23M, 23C, and 23K all perform normal discharge (S3: NO), and the operation returns to S1.

When one of the first to fourth discharge detection signal input ports 44*a*, 44*b*, 44*c*, and 44*d* is put in the "L" according to the discharge detection signals Y, M, C, and K from the discharge detection circuits 40Y, 40M, 40C, and 40K, the CPU 31 determines that abnormal discharge (arc discharge) is generated (S3: YES). Next, in S4, the CPU 31 searches the discharge detection signal input port 44 which is put in the "L", and sets the discharge detection flag corresponding to the charger 23 having detected abnormal discharge to 1.

Next, in S5, a discharge error message indicating that a discharge error occurs in the charger 23 having set the discharge detection flag to 1 is displayed on the display unit 15, such that the discharge error is notified to a user. Even if a voltage when the discharge error occurs is applied to the charger 23 and printing is continued, printing performance is bad, and the recording sheet 9 or toner 29 is wasted. Therefore, in S6, printing is interrupted.

Next, in S7, it is checked whether the cover 5 is changed from the closed state to the open state based on a detection signal of the open/close detection sensor 7. When the cover 5 is kept in the closed state (S7: NO), the operation stands by in that state since the abnormal discharge is not resolved.

When the cover 5 is changed from the closed state to the open state (S7: YES), in S8, it is checked whether the cover 5 is changed from the open state to the closed state based on the detection signal of the open/close detection sensor 7. When the cover 5 is kept in the open state (S8: NO), it is considered that the charger 23 is being cleaned, and the operation stands by in that state.

Meanwhile, when the cover 5 is changed from the open state to the closed state (S8: YES), in S9, a cleaning detection processing is executed. If the cleaning detection processing is completed, the operation returns to S1.

<Cleaning Detection Processing>

Figure 7:
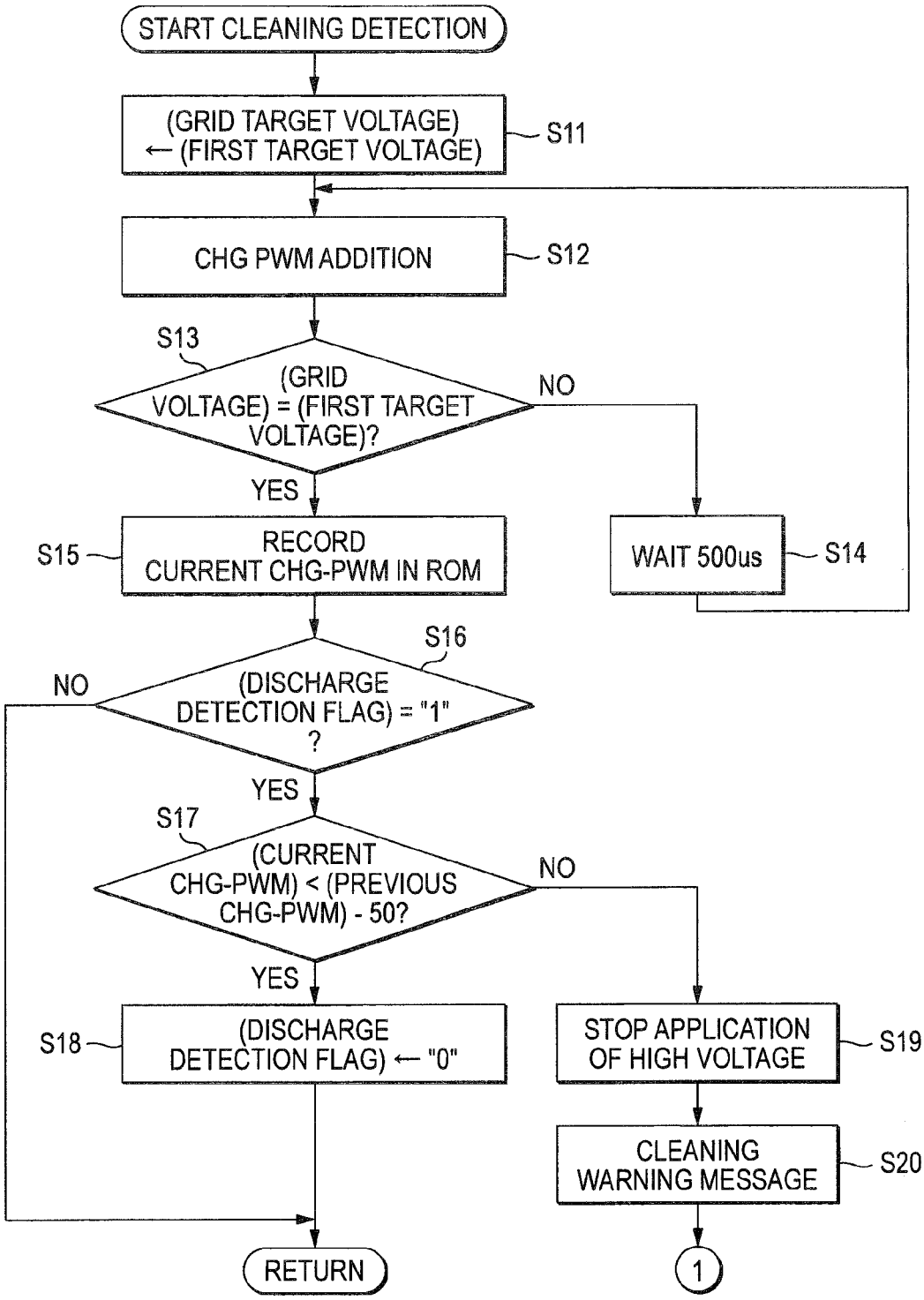
FIG. 7 is a flowchart of a cleaning detection processing shown in FIG. 6.

FIG. 7 is a flowchart of the cleaning detection processing (S9) shown in FIG. 6.

As shown in FIG. 7, the printer 1 executes a test mode in which the PWM control signal is set such that a GRID voltage becomes a first target voltage in the charger 23 having detected abnormal discharge in FIG. 6 (see S11 to S15). In addition, the printer 1 compares the PWM control signal with a PWM control signal when previous abnormal discharge is detected, and detects whether the charger 23 having detected abnormal discharge has been cleaned.

As described above, the CPU 31 of the printer 1 controls the charge voltage to be applied to the charging wires 27Y, 27M, 23C, and 27K by making the voltage in the GRID portions 28Y, 28M, 28C, and 28K constant. Therefore, in S11, the CPU 31 of the printer 1 sets the first target voltage as a target voltage (GRID target voltage) of each of the GRID portions 28Y, 28M, 28C, and 28K.

The first target voltage may be a voltage which enables the charger 23 to generate corona discharge, or may be lower than the voltage to be applied to the charger 23 when printing is performed in the normal state. In this exemplary embodiment, the GRID voltage during normal printing is at 870 V, and the first target voltage is set to 700 V. The first target voltage may be set to be different from each other for the GRID portions 28Y, 28M, 28C, and 28K according to the toner characteristics.

Next, in S12, a predetermined offset is added to the PWM control signals as an example of control information output from the first to fourth control information output ports 45*a*, 45*b*, 45*c*, and 45*d* to the chargers 23Y, 23M, 23C, and 23K. Thus, the voltage (GRID voltage) of each of the GRID portions 28Y, 28M, 28C, and 28K is increased.

Next, in S13, it is determined whether the GRID voltage of each of the GRID portions 28Y, 28M, 28C, and 28K reaches the first target voltage. When the GRID voltage of each of the GRID portions 28Y, 28M, 28C, and 28K does not reach the first target voltage (S13: NO), in S14, the operation stands by for a given waiting time (for example 500 μs), and then the operation returns to S12.

When the GRID voltage of each of the GRID portions 28Y, 28M, 28C, and 28K reaches the first target voltage (S13: YES), in S15, the PWM controls signals output from the first to fourth control information output ports 45*a*, 45*b*, 45*c*, and 45*d* to the chargers 23Y, 23M, 23C, and 23K are recorded in the ROM 32. Next, in S16, it is determined whether a charger having set the discharge detection flag to 1 exists. When no discharge detection flag is set to 1 (S16: NO), since the chargers 23Y, 23M, 23C, and 23K all perform normal discharge, the operation returns to S1 of FIG. 6.

When a charger having set the discharge detection flag to 1 exists (S16: YES), in S17, it is determined whether a current PWM control signal to be output the charger 23 having set the discharge detection flag to 1 is smaller than a value (previous PWM control signal) obtained by subtracting an error value from a PWM control signal output to the charger 23 having set the discharge detection flag to 1 when previous abnormal discharge is detected in the corresponding charger 23. The error value is preferably set to be smaller than the amount of a fluctuation in the PWM control signal when the charging wire 27 is cleaned. In the first exemplary embodiment, when the PWM control signal output from the CPU 31 has 1024 steps, and decreases by 100 steps while the charging wire 27 is cleaned, the error value is set to 50. The error value is not necessarily set.

When the current PWM control signal is smaller than the previous PWM control signal, in S18, the discharge detection flag which is set to 1 is reset to 0, that is, the charger having detected abnormal discharge is determined to be cleaned. Then, the operation returns to S1 of FIG. 6.

When the current PWM control signal is equal to or larger than the previous PWM control signal, it is considered that the charging wire 27 is not cleaned. In this case, in order to prevent abnormal discharge from being recurred, in S19, the CPU 31 stops application of the high voltage to the charger 23 by the high-voltage power supply unit 41. Next, in S20, a message for asking the user to clean the charger 23 having detected abnormal discharge is displayed on the display unit 15. Thereafter, the operation returns to S5 of FIG. 6, and stands by until the charger 23 having detected abnormal discharge has been cleaned.

Advantages of Image Forming Apparatus of First Exemplary Embodiment

In the printer 1 of the first exemplary embodiment, if the discharge detection circuit 40K detects abnormal discharge of the charger 23K, the current PWM control signal for controlling output of the high-voltage power supply unit 41K to the charger 23K having detected abnormal discharge is compared with the previous PWM control signal for controlling output of the high-voltage power supply unit 41K to the charger 23K having detected abnormal discharge when previous abnormal discharge is detected in the corresponding charger 23K. Then, it is determined whether the charger 23K having detected abnormal discharge by the discharge detection circuit 40K has been cleaned (see S3: YES, S9 in FIG. 6, and S17 in FIG. 7). Therefore, according to the printer 1 of the first exemplary embodiment, it is possible to confirm whether the charger 23K has been cleaned after the discharge detection circuit 40K detects abnormal discharge.

In the printer 1 of the first exemplary embodiment, when it is detected that the charger 23K having detected abnormal discharge is not cleaned, power output to the charger 23K by the high-voltage power supply unit 41K is limited (see S17: NO, S19 in FIG. 7). Therefore, it is possible to prevent abnormal discharge from being recurred in the charger 23K having detected abnormal discharge.

In the printer 1 of the first exemplary embodiment, if the discharge detection circuit 40K detects abnormal discharge of the charger 23K before printing is performed, it is detected whether the charger 23K has been cleaned (see S1: YES, S9 in FIG. 6). Therefore, after it is confirmed that the charger 23K having detected abnormal discharge has been cleaned, print data can be printed.

In the printer 1 of the first exemplary embodiment, it is detected whether a charger 23K having detected abnormal discharge among a plurality of chargers 23Y, 23M, 23C, and 23K has been cleaned (see S16: YES in FIG. 7). Therefore, it is not necessary to clean the chargers 23Y, 23M, 23C not having detected abnormal discharge. As a result, cleaning detection can be performed in a short time.

Second Exemplary Embodiment

Figure 8:
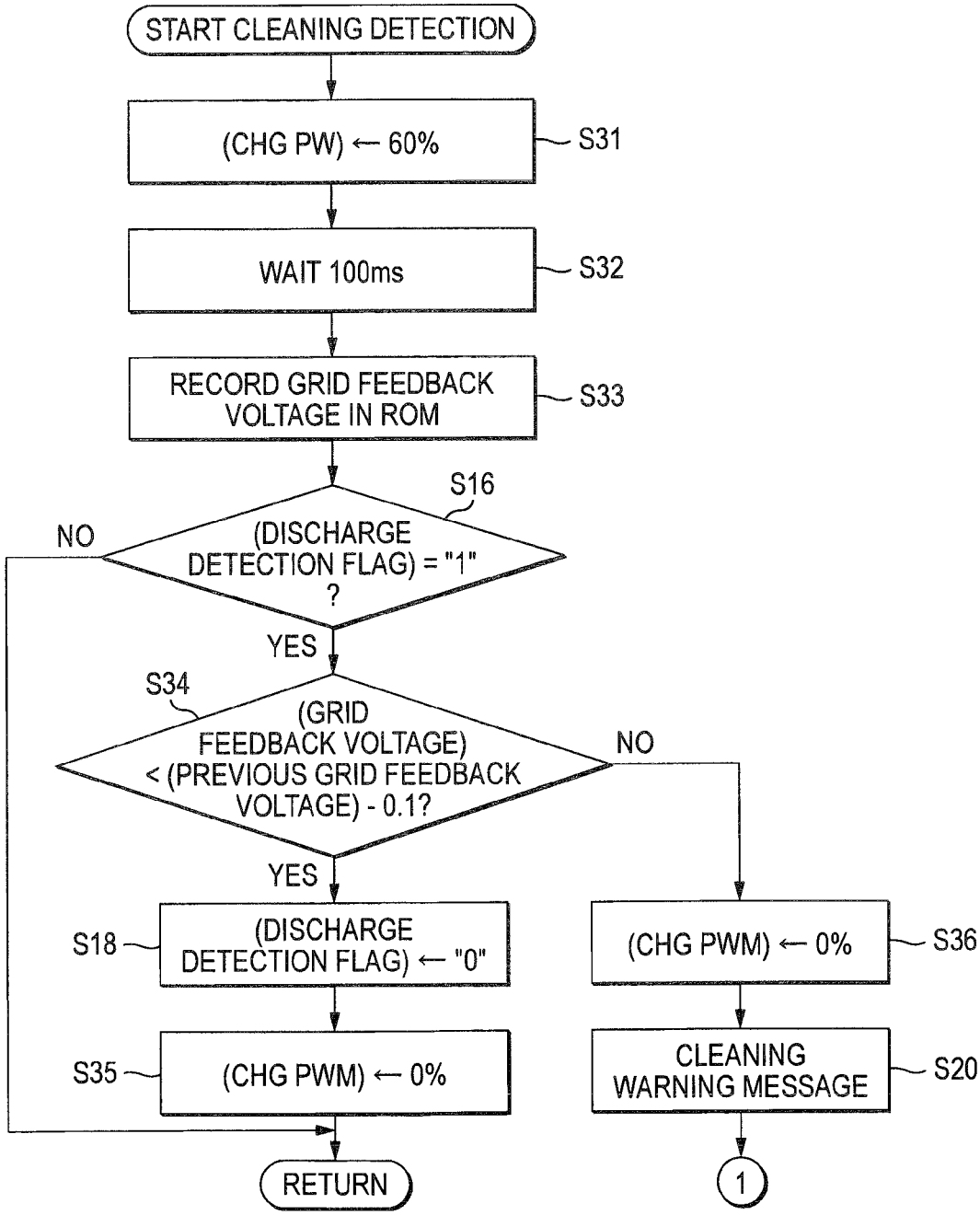
FIG. 8 is a flowchart showing a procedure of a cleaning detection processing which is executed by an image forming apparatus according to a second exemplary embodiment of the invention.

A second exemplary embodiment of the invention will now be described with reference to FIG. 8. FIG. 8 is a flowchart showing a procedure of a cleaning detection processing which is executed by a printer 1A according to the second exemplary embodiment of the invention.

The printer 1A of the second exemplary embodiment is the same as the printer 1 of the first exemplary embodiment except for the procedure of a cleaning detection processing to be executed in a discharge detection program 36A. Therefore, only the cleaning detection processing will be described hereinafter, and descriptions of other parts will be omitted.

The cleaning detection processing according to the second exemplary embodiment as shown in FIG. 8 is different from the first exemplary embodiment in that, based on the duty value of the PWM control signal output from the control information output port 45 to the charger 23, the CPU 31 detects whether the charger 23 has been cleaned.

In S31 of FIG. 8, the CPU 31 sets the duty value of each of the PWM control signals output from the control information output ports 45*a*, 45*b*, 45*c*, 45*d* to the chargers 23Y, 23M, 23C, and 23K to a value (for example 60%) lower than the duty value (for example, 70 to 80%) during normal printing. Next, in S32, the operation stands by for 100 ms until the voltage of each of the GRID portions 28Y, 28M, 28C, and 28K is stabilized.

Next, in S33, the first to fourth A/D ports 43*a*, 43*b*, 43*c*, and 43*d* record, in the ROM 32, the voltage (GRID feedback voltage) supplied from the GRID portions 28Y, 28M, 28C, and 28K.

In S16, when the discharge detection flag corresponding to one of the chargers 23Y, 23M, 23C, and 23K is set to 1 (S16: YES), in S34, it is determined whether a current GRID feedback voltage, which is an example of current control information for controlling output of the high-voltage power supply unit 41 to the charger 23 having detected abnormal discharge is smaller than a value (previous GRID feedback voltage which is an example of previous control information) obtained by subtracting an error value (for example, 0.1) from a GRID feedback voltage for controlling output of the high-voltage power supply unit 41 to the charger 23 having detected abnormal discharge when previous abnormal discharge is detected in the corresponding charger 23.

When the current GRID feedback voltage is smaller than the previous GRID feedback voltage (S34: YES), in S18, the discharge detection flag which is set to 1 is reset to 0. Next, in S35, the duty value of the PWM control signal to be output to the charger 23 having detected abnormal discharge from the control information output port 45 is set to 0%. Then, the operation returns to S1 of FIG. 6.

When the current GRID feedback voltage is equal to or larger than the previous GRID feedback voltage (S34: NO), in S36, the duty value of the PWM control signal to be output to the charger 23 having detected abnormal discharge from the control information output port 45 is set to 0%. Next, in S20, a cleaning warning message is displayed on the display unit 15. Then, the operation returns to S1 of FIG. 6.

Advantages of Image Forming Apparatus of Second Exemplary Embodiment

The printer 1A of the second exemplary embodiment shows the same advantages as those in the printer 1 of the first exemplary embodiment. In summary, in the printer 1A of the second exemplary embodiment, when the discharge detection circuit 40K detects abnormal discharge of the charger 23K, a current GRID feedback voltage for controlling output of the high-voltage power supply unit 41K to the charger 23K having detected abnormal discharge is compared with a previous GRID feedback voltage for controlling output of the high-voltage power supply unit 41 to the charger 23K having detected abnormal discharge when previous abnormal discharge is detected in the corresponding charger 23K. Then, it is determined whether the charger 23K having detected abnormal discharge by the discharge detection circuit 40K has been cleaned (see S34 in FIG. 8). Therefore, according to the printer IA of the second exemplary embodiment, it is possible to confirm whether the charger 23K has been cleaned after the discharge detection circuit 40K detects abnormal discharge.

In the printer 1A of the second exemplary embodiment, when it is detected that the charger 23K having detected abnormal discharge is not cleaned, the duty value of the PWM control signal to be output from the control information output port 45*d* to the charger 23K is set to 0%, such that power output to the charger 23K by the high-voltage power supply unit 41K is limited (see S34: NO, S36 in FIG. 8). Therefore, it is possible to prevent abnormal discharge from being recurred in the charger 23K having detected abnormal discharge.

Third Exemplary Embodiment

Figure 9:
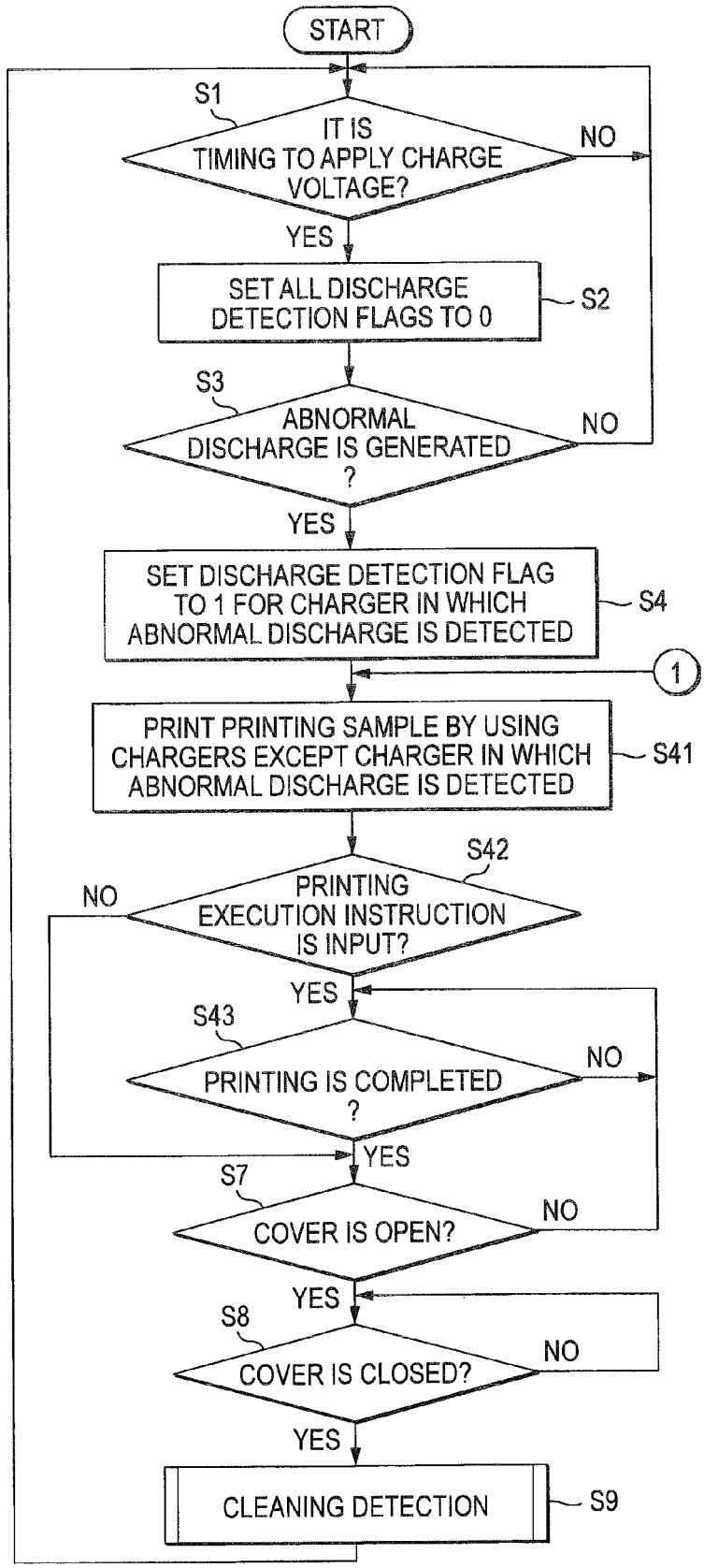
FIG. 9 is a flowchart of a discharge detection program which is executed by an image forming apparatus according to a third exemplary embodiment of the invention.

A third exemplary embodiment of the invention will now be described with reference to FIG. 9. FIG. 9 is a flowchart of a discharge detection program 36B which is executed by a printer 1B according to a third exemplary embodiment of the invention.

The printer 1B of the third exemplary embodiment is the same as the first exemplary embodiment, except that after abnormal discharge is detected, a cleaning detection processing is executed while printing is performed. Therefore, a description will be given hereinafter laying emphasis on a difference from the first exemplary embodiment. In addition, the same parts as those in the first exemplary embodiment will be represented by the same reference numerals, and descriptions thereof will be omitted.

In S4 of FIG. 9, if the discharge detection flag corresponding to the charger 23K having detected abnormal discharge is set to 1, in S41, the CPU 31 of the printer 1B outputs the PWM control signals to the charger 23Y, 23M, and 23C not having detected abnormal discharge through the control information output ports 45*a*, 45*b*, and 45*c*, and prints a printing sample. Next, in S42, it is determined whether a print instruction is input.

When the user views the printing sample and considers that it is not preferable to perform printing by applying the charge voltage to the chargers 23Y, 23M, and 23C not having detected abnormal discharge, the user does not input a print instruction to the operation unit 14. In this case (S42: NO), the operation proceeds to S7.

Meanwhile, when the user views the printing sample and considers that it is preferable to perform printing by applying the charge voltage to the chargers 23Y, 23M, and 23C not having detected abnormal discharge, he/she inputs the print instruction to the operation unit 14. In this case (S42: YES), in S43, it is determined whether printing is completed. Until printing is completed (S43: NO), the operation stands by in that state. After printing is completed (S43: YES), the operation proceeds to S7.

Advantage of Image Forming Apparatus of Third Exemplary Embodiment

In the printer 1B of the third exemplary embodiment, assuming that the discharge detection circuit 40K detects abnormal discharge, printing is performed by using the charger 23Y, 23M, and 23C corresponding to the discharge detection circuits 40Y, 40M, 40C which do not detect abnormal discharge (see S3: YES, S41 in FIG. 9). That is, when the contents to be printed are known and a color to be printed is not limited to black, before it is detected whether the charger 23K has been cleaned, printing is performed by applying voltages to the chargers 23Y, 23M, and 23C. Therefore, according to the printer 1B of the third exemplary embodiment, it is not necessary to stand by until cleaning detection is performed in the charger 23K. As a result, printing can be performed in a short time.

At this time, the printer 1B of the third exemplary embodiment does not print the print data immediately and prints the printing sample (see S41 of FIG. 9). Therefore, according to the printer 1B of the third exemplary embodiment, the user can be asked to determine whether to print the print data after confirming printing performing based on the printing sample.

Fourth Exemplary Embodiment

Figure 10:
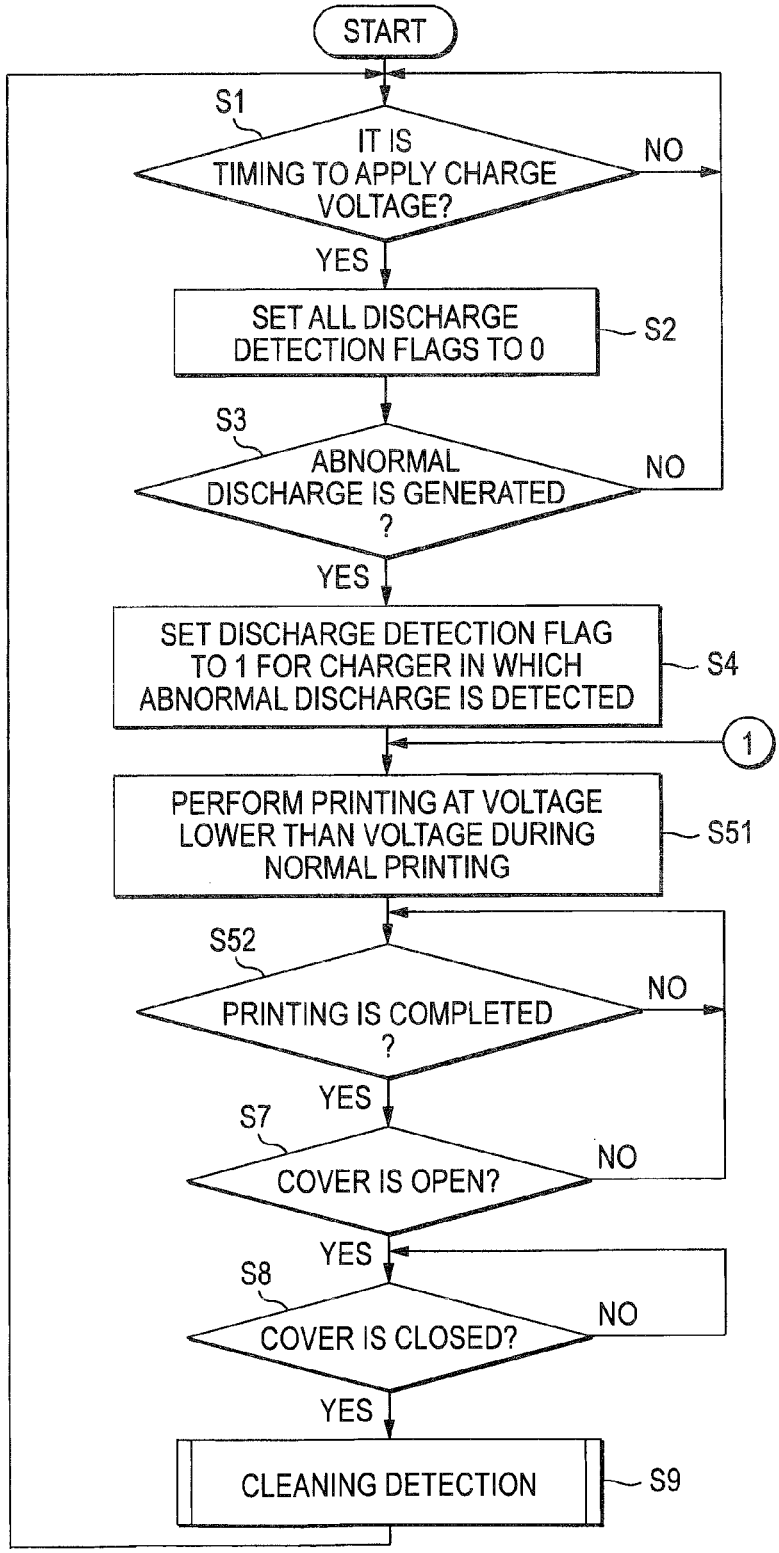
FIG. 10 is a flowchart of a discharge detection program which is executed by an image forming apparatus according to a fourth exemplary embodiment of the invention.

A fourth exemplary embodiment of the invention will now be described with reference to FIG. 10. FIG. 10 is a flowchart of a discharge detection program 36C which is executed by a printer 1C according to the fourth exemplary embodiment of the invention.

The printer 1C of the fourth exemplary embodiment is the same as the first exemplary embodiment, except that printing is performed while the voltage applied to the charger 23 which performs abnormal discharge is decreased, and thereafter a cleaning detection processing is performed. Therefore, a description will be given hereinafter laying emphasis on a difference from the first exemplary embodiment. In addition, the same parts as those in the first exemplary embodiment will be represented by the same reference numerals, and descriptions thereof will be omitted.

In S4 of FIG. 10, if the discharge detection flag corresponding to the charger 23 having detected abnormal discharge is set to 1, in S51, the CPU 31 of the printer 1C performs printing by applying, to the charger 23 having detected abnormal discharge, a voltage lower than the voltage during normal printing. Next, in S52, it is determined whether printing is completed. Until printing is completed (S52: NO), the operation stands by in that state. After printing is completed (S52: YES), the operation proceeds to S7.

Advantages of Image Forming Apparatus of Fourth Exemplary Embodiment

In the printer 1C of the fourth exemplary embodiment, assuming that the discharge detection circuit 40K detects abnormal discharge in the charger 23K, the PWM control signal to be output from the control information output port 45 is controlled such that the voltage to be applied to the charger 23K becomes lower than a first target voltage (for example, 700 V), and then printing is performed (see S51 of FIG. 10). That is, print data is printed while abnormal discharge of the charger 23K is avoided. Therefore, according to the printer 1C of the fourth exemplary embodiment, when a print concentration is not cared, printing can be performed in a short time without standing by until cleaning detection is performed.

In this exemplary embodiment, only the voltage to be applied to the charger 23K having detected abnormal discharge is decreased. Alternatively, for the chargers 23Y, 23M, and 23C not having detected abnormal discharge similarly to the charger 23K having detected abnormal discharge, the voltage to be applied may be decreased in terms of printing balance.

While the present invention has been shown and described with reference to certain exemplary embodiments thereof, it will be understood by those skilled in the art that various changes in form and details may be made therein without departing from the spirit and scope of the invention as defined by the appended claims.

(1) In the above exemplary embodiments, the discharge detection circuits 40Y, 40M, 40C, and 40K are provided correspondingly to the chargers 23K, 23M, 23C, and 23K, but the chargers 23Y, 23M, 23C, and 23K may be connected in parallel to one discharge detection circuit 40. Alternatively, the chargers 23Y, 23M, 23C which are less frequently used than the charger 23K may be connected to one discharge detection circuit 40. As such, even if the chargers 23 are connected in parallel to the discharge detection circuit 40, a charger 23 which generates abnormal discharge may be specified, and cleaning detection may be performed for the specified charger 23.

(2) In the above exemplary embodiments, abnormal discharge and cleaning detection is performed for the chargers 23K, 23M, 23C, and 23K. Alternatively, static eliminators 26Y, 26M, 26C, and 26K may be connected to the CPU 31 through the discharge detection circuits 40Y, 40M, 40C, and 40K, and abnormal discharge and cleaning detection may be performed for the static eliminators 26Y, 26M, 26C, and 26K.

(3) In the first exemplary embodiment, in order to detect whether the charger 23 having detected abnormal discharge has been cleaned, the current PWM control signal is compared with the value obtained by subtracting the error value from the previous PWM control signal. Alternatively, when the high-voltage power supply unit 41 is a minus power source, the current PWM control signal may be compared with a value obtained by adding the error value to the previous PWM control signal.

What is claimed is:

1. An image forming apparatus comprising:

a photosensitive member;

a discharging unit arranged to face the photosensitive member;

a high-voltage power supply unit which supplies power to the discharging unit;

a discharge detection unit which detects abnormal discharge in the discharging unit;

an output controller which controls an output of the high-voltage power supply unit according to control information; and a cleaning detection unit which compares current control information for the high-voltage power supply unit supplying power to the discharging unit in which abnormal discharge is detected with previous control information for the high-voltage power supply unit when previous abnormal discharge is detected in the discharging unit, and which detects whether the discharging unit has been cleaned based on the comparison result.

2. The image forming apparatus according to claim 1, wherein the output controller limits the output of the high-voltage power supply unit to the discharging unit if it is detected that the discharging unit has not been cleaned.

3. The image forming apparatus according to claim 1, further comprising a cleaning detection controller which controls the cleaning detection unit to detect whether the discharging unit has been cleaned when the discharge detection unit detects abnormal discharge.

4. The image forming apparatus according to claim 1, wherein the output controller controls the output of the high-voltage power supply unit to be a target value with using a PWM control signal as the control information.

5. The image forming apparatus according to claim 4, wherein the cleaning detection unit compares a current PWM control signal when the output of the high-voltage power supply unit is a first target value with a previous PWM control signal when the previous abnormal discharge is detected and the output of the high-voltage power supply unit is the first target value.

6. The image forming apparatus according to claim 5, wherein the cleaning detection unit detects that the discharge unit has been cleaned if the current PWM control signal is smaller than a value obtained by subtracting a predetermined value from the previous PWM control signal.

7. The image forming apparatus according to claim 1, further comprising a feedback voltage detection unit which detects a grid voltage related to a potential of the photosensitive members as the control information, wherein the output controller controls the output of the high-voltage power supply unit with a PWM control signal determined according to the detected grid voltage.

8. The image forming apparatus according to claim 7, wherein the cleaning detection unit compares a current grid voltage detected when the PWM control signal has a predetermined duty value and a previous grid voltage detected when the previous abnormal discharge is detected and the PWM control signal has the predetermined duty value.

9. The image forming apparatus according to claim 1, wherein the discharging unit includes a charger which charges the photosensitive member.

10. The image forming apparatus according to claim 1, wherein the discharging unit includes a static eliminator which generates corona discharge.

11. An image forming unit comprising:

a plurality of photosensitive members;

a plurality of discharging units arranged to face the plurality of photosensitive members, respectively;

a plurality of high-voltage power supply units which are provided for the plurality of discharging units and supply power to the plurality of discharging units, respectively;

a discharge detection unit which detects abnormal discharge in the plurality of discharging units;

an output controller which controls outputs of the high-voltage power supply units according to control information, respectively;

a cleaning detection unit which compares current control information for one of the high-voltage supply units corresponding to one of the discharging unit in which abnormal discharge is detected with previous control information for the one of the high-voltage supply units when previous abnormal discharge is detected in the one of the discharging units, and which detects whether the one of the discharging units has been cleaned based on the comparison result.

12. The image forming apparatus according to claim 11, further comprising a printing execution unit which performs printing by using the discharging units except for the one of the discharging unit in which abnormal discharge is detected.

13. The image forming apparatus according to claim 12, wherein the printing execution unit prints a print sample.

14. The image forming apparatus according to claim 11, wherein the output controller controls the outputs of the high-voltage power supply units to be target values with using PWM control signals as the control information, respectively.

15. The image forming apparatus according to claim 14, wherein the cleaning detection unit compares a current PWM control signal for the one of the high-voltage supply units corresponding to the one of the discharging unit in which abnormal discharge is detected when the output of the one of the high-voltage supply units is a first target value with a previous PWM control signal for the one of the high-voltage supply units when the previous abnormal discharge is detected and the output of the one of the high-voltage power supply units is the first target value.

16. The image forming apparatus according to claim 15, wherein the cleaning detection unit detects that the one of the discharge units in which abnormal discharge is detected has been cleaned if the current PWM control signal is smaller than a value obtained by subtracting a predetermined value from the previous PWM control signal.

17. The image forming apparatus according to claim 11, farther comprising a plurality of feedback voltage detection units for the plurality of photosensitive members, respectively, wherein, each of the feedback voltage detection units detects a grid voltage related to a potential of corresponding one of the photosensitive members as the control information, and wherein the output controller controls the outputs of the high-voltage power supply units with PWM control signals determined according to the detected grid voltages, respectively.

18. The image forming apparatus according to claim 17, wherein the cleaning detection unit compares a current grid voltage detected when the PWM control signal for the one of the discharging units in which abnormal discharge is detected has a predetermined duty value and a previous grid voltage detected when the previous abnormal discharge in the one of the discharging units is detected and the PWM control signal for the one of the discharging units has the predetermined duty value.

* * * * *